US008002435B2

(12) United States Patent
Laporte

(10) Patent No.: US 8,002,435 B2
(45) **Date of Patent: *Aug. 23, 2011**

(54) ORIENTABLE LENS FOR AN LED FIXTURE

(75) Inventor: Jean-Francois Laporte, Boisbriand (CA)

(73) Assignee: Philips Electronics LTD Philips Electronique LTEE, Ontario (CA)

( * ) Notice: Subject to any disclaimer, the term of this patent is extended or adjusted under 35 U.S.C. 154(b) by 216 days.

This patent is subject to a terminal disclaimer.

(21) Appl. No.: 12/327,432

(22) Filed: Dec. 3, 2008

(65) Prior Publication Data

US 2009/0310356 A1 Dec. 17, 2009

Related U.S. Application Data

(63) Continuation-in-part of application No. 12/171,362, filed on Jul. 11, 2008, now Pat. No. 7,766,509.

(60) Provisional application No. 61/061,392, filed on Jun. 13, 2008.

(51) Int. Cl.
*F21S 4/00* (2006.01)
*F21V 21/00* (2006.01)

(52) U.S. Cl. ..... 362/249.02; 362/249.03; 362/283; 362/311.02; 362/323; 362/327; 362/800

(58) Field of Classification Search ..... 362/249.01–249.04, 277, 282–283, 362/311.02, 322–323, 327, 800
See application file for complete search history.

(56) References Cited

U.S. PATENT DOCUMENTS 7,222,995 B1 * 5/2007 Bayat et al. ..... 362/327
7,674,018 B2 * 3/2010 Holder et al. ..... 362/311.06

* cited by examiner

*Primary Examiner* — Jason Moon Han
(74) *Attorney, Agent, or Firm* — John Salazar; Mark Beloborodov

(57) ABSTRACT

A mounting surface for mounting a plurality of LEDs has a plurality of orientable lenses each individually affixed about a single LED. Each orientable lens has a primary reflector and a refracting lens that direct light emitted from a single LED to a reflective surface of the orientable lens that reflects the light off a primary LED light output axis.

15 Claims, 14 Drawing Sheets

ORIENTABLE LENS FOR AN LED FIXTURE

CROSS-REFERENCE TO RELATED APPLICATIONS

This application is a continuation-in-part, under 35 USC §120, of U.S. application Ser. No. 12/171,362, filed Jul. 11, 2008, entitled "Orientable Lens for an LED Fixture," which is currently pending, naming Jean-François Laporte as the sole inventor. U.S. application Ser. No. 12/171,362, under 35 USC §119(e) claims priority to, and benefit from, U.S. Provisional Application No. 61/061,392, filed Jun. 13, 2008, entitled "Orientable Lens for a LED Fixture," naming Jean-François Laporte as the sole inventor. Each patent application identified above is incorporated herein by reference in its entirety.

BACKGROUND OF THE INVENTION

1. Field of the Invention

The present invention is related generally to an orientable lens, and more specifically to a positioning sheet for orientable lenses for a light emitting diode fixture.

2. Description of Related Art

Light emitting diodes, or LEDs, have been used in conjunction with various lenses that reflect light emitted by the LED. Also, various lenses have been provided for use in light fixtures utilizing a plurality of LEDs as a light source.

DETAILED DESCRIPTION

Figure 1:
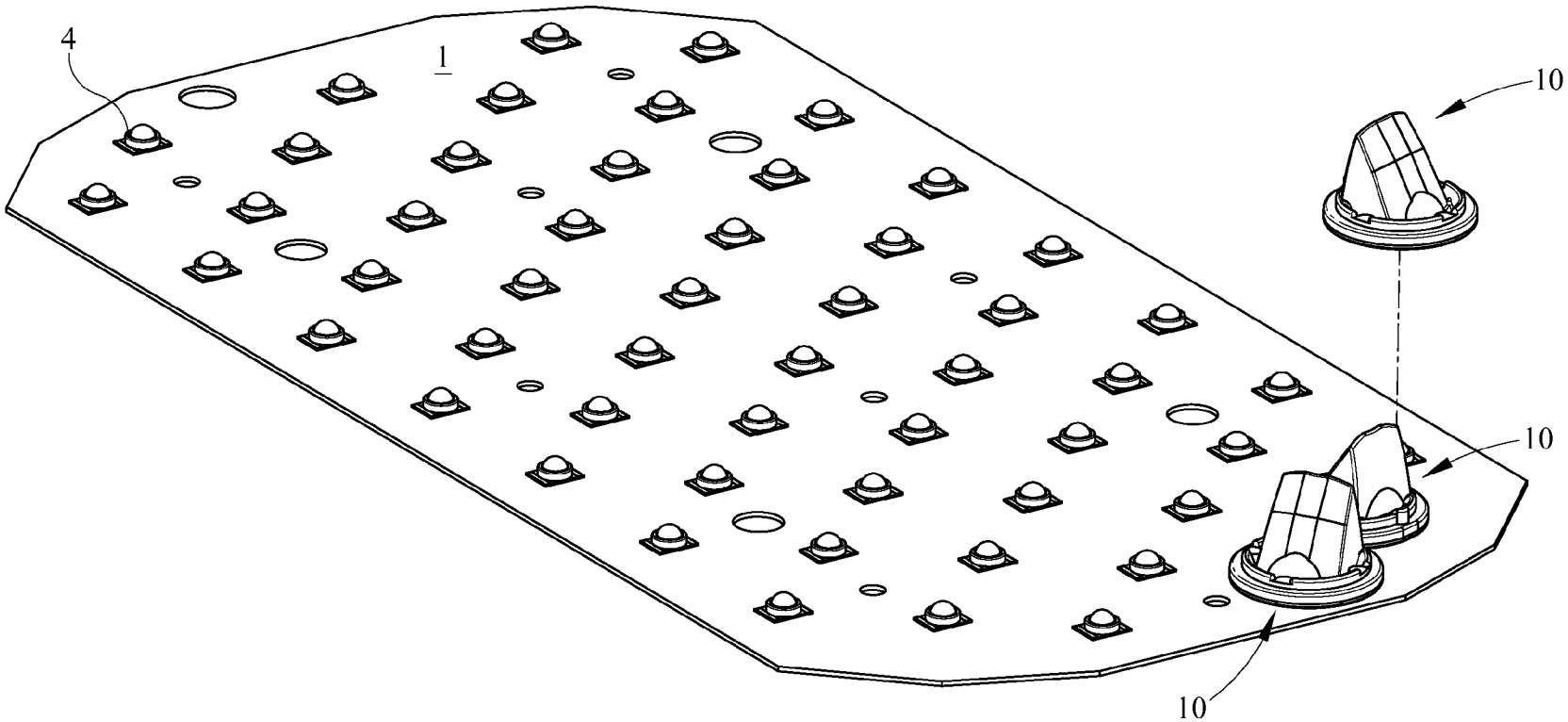
FIG. 1 is a top perspective view of the LED fixture with orientable lens of the present invention wherein a flat board is populated with a plurality of LEDs and shown with three orientable lenses, two of which are affixed to the flat board about respective LEDs and one of which is shown exploded away from its respective LED.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Referring now in detail to FIGS. 1-10, wherein like numerals indicate like elements throughout the several views, there are shown various aspects of an orientable lens for a LED fixture. Orientable lens is usable in conjunction with a single LED and may be installed and used with a variety of LEDs. Orientable lens is preferably used as a lens for a LED with a Lambertian light distribution although it may be configured for and used as a lens for LEDs having other light distributions as well. FIG. 1 shows a LED flat board 1, on which is mounted fifty-four LEDs 4 with a Lambertian light distribution. In some embodiments of LED flat board 1, LED flat board 1 is a metallic board with advantageous heat distribution properties such as, but not limited to, aluminum. In other embodiments LED flat board 1 is a flame retardant 4 (FR-4) or other common printed circuit board. LED flat board 1 and plurality of LEDs 4 are merely exemplary of the multitude of boards, number of LEDs, and multitude of LED configurations in which a plurality of orientable lenses for a LED may be used. Design considerations such as, but not limited to, heat, desired lumen output, and desired light distribution pattern may result in a choice of differing amounts of LEDs, differing LED configurations, and/or differing materials.

Also shown in FIG. 1 are three of one embodiment of orientable lens 10, two of which are shown placed over respective LEDs 4 and mated to flat board 1 and one of which is shown exploded away from its respective LED 4. Being orientable means that each lens is individually adjustable to a given orientation about a given LED. As will become clear, when a plurality of orientable lenses 10 are used in conjunction with a plurality of LEDs, each orientable lens 10 may be individually oriented without regard to the orientation of other orientable lenses 10, such as, for example, the three orientable lenses 10 of FIG. 1 which are each oriented in a unique direction. Moreover, when a plurality of LEDs are present, as few as one LED, or as many as all LEDs in some preferred embodiments, may be provided with an individual orientable lens 10. Some or all lenses may be individually and permanently adjusted to a given orientation upon creation of the LED fixture with an orientable lens or some or all lenses may be attached to allow for adjustment in the field. Thus, complex photometric distribution patterns and a flexibility of distribution patterns may be achieved when using a plurality of orientable lenses 10 with a plurality of LEDs, such as, but not limited to, plurality of LEDs 4 on flat board 1.

Figure 2:
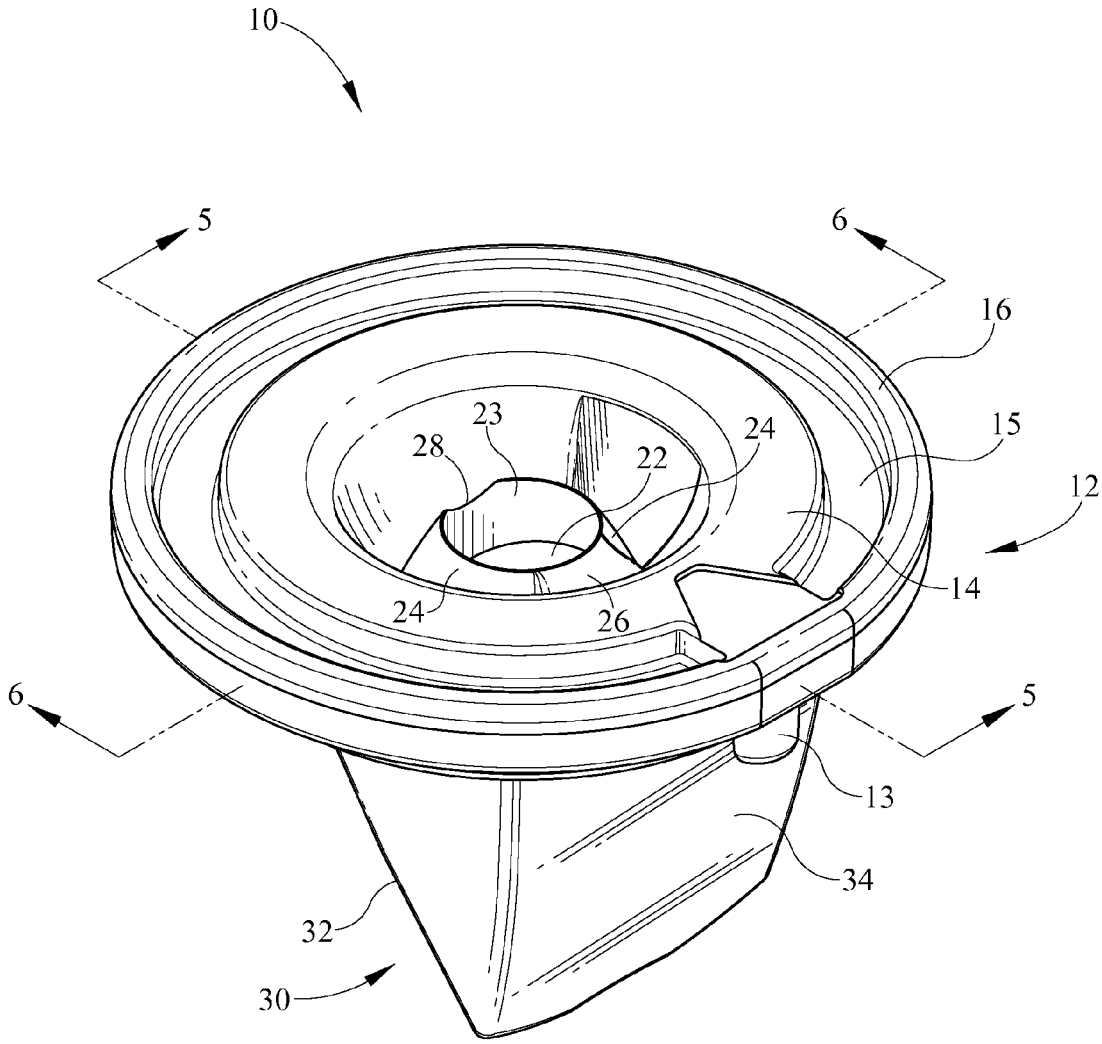
FIG. 2 is a top perspective view of one of the orientable lenses of FIG. 1.
Figure 3:
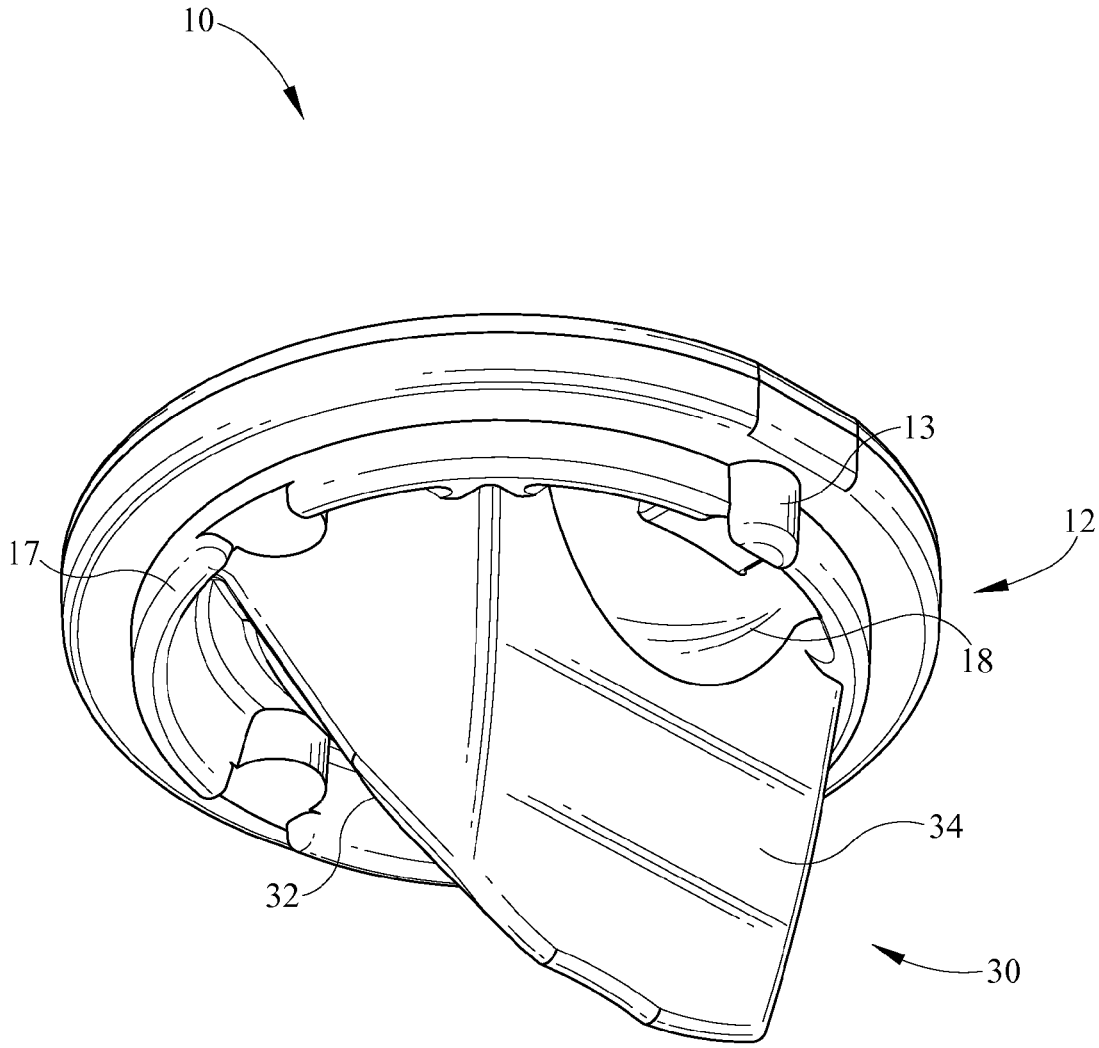
FIG. 3 is a bottom perspective view of the orientable lens of FIG. 2.
Figure 4A:
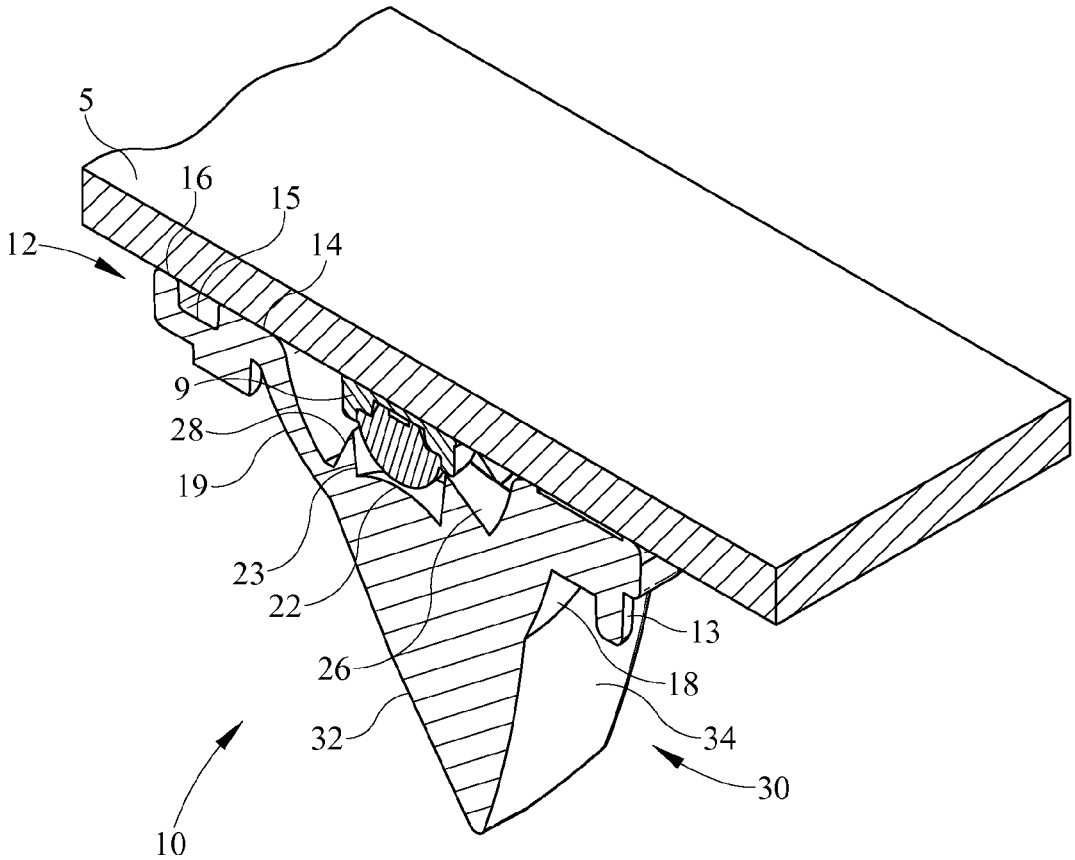
FIG. 4A is a top perspective view of the orientable lens of FIG. 2 taken along the line 5-5, and a sectioned view of a LED attached to a mounting surface, with the orientable lens affixed to the mounting surface about the LED.
Figure 4B:
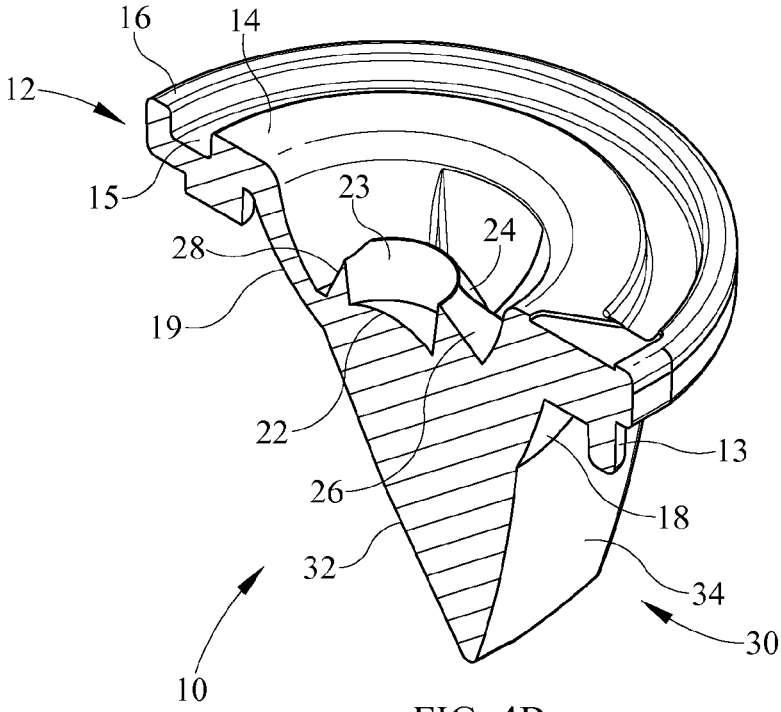
FIG. 4B is a top perspective view of the orientable lens of FIG. 2 taken along the line 5-5.

Turning now to FIG. 2 and FIG. 3, an embodiment of orientable lens 10 is shown in more detail. Orientable lens 10 has a base 12 that is shown in this embodiment as having a substantially flat and substantially circular inner and outer mating surface 14 and 16, each with substantially circular inner and outer peripheries. Base 12 of FIG. 2 is also shown with a recessed portion 15 provided in between a substantial portion of inner and outer mating surfaces 14 and 16. Base 12 is provided, among other things, for attachment of orientable lens 10 to a surface on which a LED is mounted, such as, for example, attachment to flat board 1 of FIG. 1. Attachment of base 12 to a surface on which a LED is mounted and not to a LED itself reduces heat transfer from a LED to orientable lens 10. In some embodiments both inner and outer mating surface 14 and 16 mate with a surface for attachment of orientable lens 10. In some embodiments only inner mating surface 14 mates with a surface for attachment of orientable lens 10 and outer mating surface 16 interacts with a surface for alignment of orientable lens 10 about an LED. In some embodiments inner and/or outer mating surface 14 and 16 or other provided surface may be adhered to a mounting surface for attachment of orientable lens 10. In some embodiments inner and/or outer mating surface 14 and 16 or other provided surface may be snap fitted with a mounting surface for attachment of orientable lens 10. In some embodiments inner and/or outer mating surface 14 and 16 or other provided surface may be compressed against a mounting surface for attachment of orientable lens 10. Other attachment means of base 12 to a mounting surface may be provided as are generally known to those of ordinary skill in the art and as may be based on the teachings hereof.

Figure 6A:
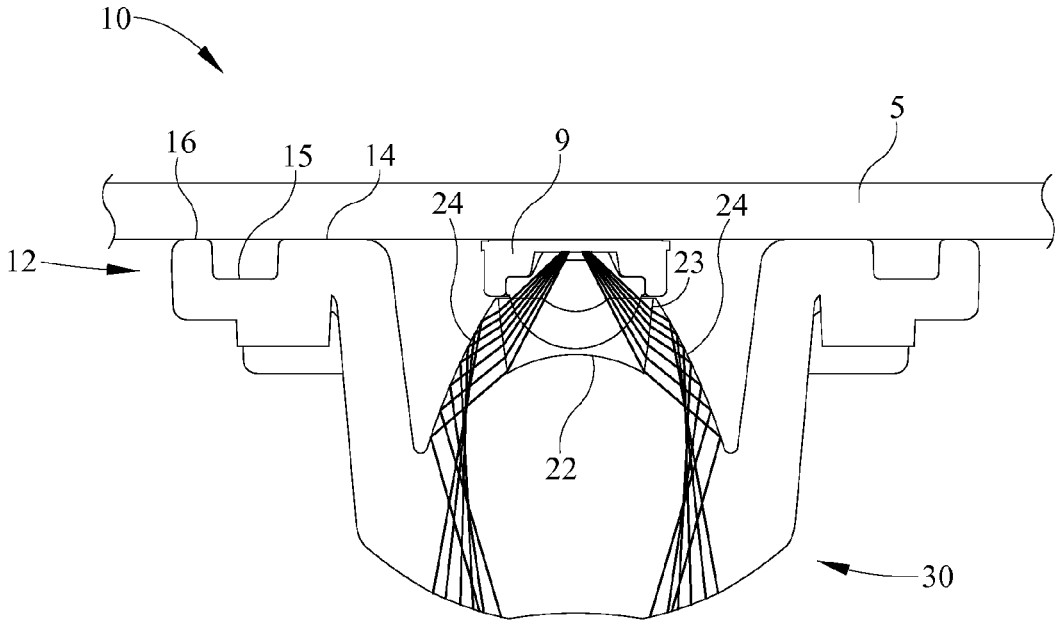
FIG. 6A is a sectional view of the orientable lens of FIG. 2 taken along the line 6-6 and shown with a ray trace of exemplary light rays that emanate from a source and contact portions of a primary reflector.
Figure 6B:
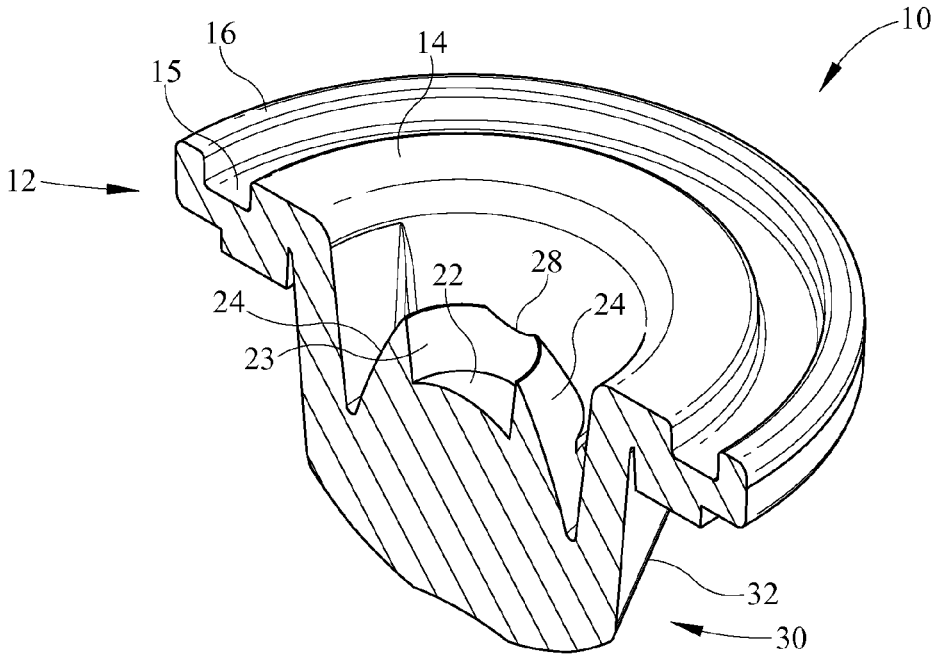
FIG. 6B is a front top perspective view of the orientable lens of FIG. 2 taken along the line 6-6.

Base 12 also has portions that may be provided for aesthetic purposes or support or attachment of other constituent parts of orientable lens 10. For example, in some preferred embodiments, at least primary reflector 24 (as shown in FIG. 6A) and reflecting prism 30 are attached to and supported by base 12. Some embodiments of orientable lens 10 may be provided with a base 12 having supports 18 or 19 that may help provide for support of reflecting prism 30 and may also be provided to fully seal orientable lens 10. Some embodiments of base 12 of orientable lens 10 may also be provided with rim portion 17 and like appendages if desired for ease in installation or other reasons. In some embodiments, when orientable lens is installed about a LED on a mounting surface, a sheet or other object may contact rim portion 17, or other portions of base 12, such as the flange portion provided around rim portion 17 and provide compressive force on orientable lens 10 in the direction of the mounting surface, thereby causing inner and/or outer mating surfaces 14 and 16 to mate with the mounting surface for attachment of orientable lens 10.

In other embodiments base 12 may take on different shapes and forms so long as it enables orientable lens 10 to be appropriately used with a given LED and be installable at any orientation around an LED light output axis, the LED light output axis being an axis emanating from the center of the light emitting portion of any given LED and oriented away from the LED mounting surface. For example, base 12 may be provided in some embodiments without recessed portion 15 and with only one distinct mating surface, as opposed to inner and outer mating surfaces 14 and 16. Also, for example, base 12 may be provided with inner and/or outer peripheries that have a shape other than circular. Also, for example, base 12 may be provided with other configurations for attachment to and/or support of constituent parts of orientable lens 10, such as primary reflector 24 and reflecting prism 30. Other variations on base 12 will be apparent to one skilled in the art.

Also shown in FIG. 2 are portions of a refracting lens 22, primary reflector 24, a surface 26, a reflecting portion 28, and reflecting prism 30. When orientable lens 10 is placed about an LED and base 12 is affixed to a surface, such as LED 9 and surface 5 of FIG. 4A, FIG. 5A, FIG. 5B, and FIG. 6A, refracting lens 22 and primary reflector 24 are proximal LED 9. In particular, primary reflector 24 is positioned such that it partially surrounds the light emitting portion of LED 9 and refracting lens 22 is positioned such that it intersects the LED light output axis of LED 9 and is partially surrounded by primary reflector 24. In some embodiments primary reflector 24 is a parabolic reflector. Refracting lens 22 and primary reflector 24 are positioned so that a majority of light emitted from LED 9 will collectively be incident upon one of the two. In some embodiments, primary reflector 24 may be provided such that it completely surrounds the light emitting portion of LED 9. In some embodiments, such as those shown in the figures, primary reflector 24 only partially surrounds the light emitting portion of LED 9 and reflecting portion 28 is provided on one side of the light emitting portion of LED 9 positioned adjacent primary reflector 24 and surface 26 is provided on a substantially opposite side of the light emitting portion of LED 9 and also positioned adjacent primary reflector 24.

In some additional embodiments refracting lens 22 is positioned at the base of sidewall 23 and sidewall 23 substantially surrounds the light emitting portion of LED 9. A majority of rays emanating from LED 9 and incident upon refracting lens 22 will be refracted such that they are directed towards a reflective surface 32 of reflecting prism 30. In some embodiments, refracting lens 22 is configured such that it refracts rays so they are substantially collimated towards reflective surface 32, such as the exemplary rays shown in FIG. 5A.

In other embodiments, other rays emanating from LED 9 will be incident upon sidewall 23 proximal primary reflector 24, pass therethrough at an altered angle and will be incident upon primary reflector 24. A majority of rays incident upon primary reflector 24 are reflected and directed towards reflective surface 32 of reflecting prism 30, such as the exemplary rays shown in FIG. 6A which are directed towards portions of reflective surface 32 not shown in the figure, but evident from reference to other figures. In some embodiments of orientable lens 10, primary reflector 24 has a composition and orientation such that a majority of rays incident upon it are internally reflected and directed towards reflective surface 32. In other embodiments, primary reflector 24 is composed of a reflective material.

In additional embodiments, other rays emanating from LED 9 will be incident upon sidewall 23 proximal reflecting portion 28, pass therethrough at an altered angle and will be incident upon reflecting portion 28. A majority of rays incident upon reflecting portion 28 are reflected and directed towards reflective surface 32 of reflecting prism 30, such as the exemplary rays shown incident upon reflecting portion 28 and directed towards reflective surface 32 in FIG. 5B. In some embodiments reflecting portion 28 is positioned and configured to direct light rays in a unique direction from those rays directed by primary reflector 24 and refracting lens 22 such that they also exit orientable lens 10 in a unique direction. In embodiments of orientable lens 10 reflecting portion 28 has a composition and orientation such that a majority of rays incident upon it are internally reflected and directed towards reflective surface 32. In other embodiments, reflecting portion 28 is composed of a reflective material.

Figure 5A:
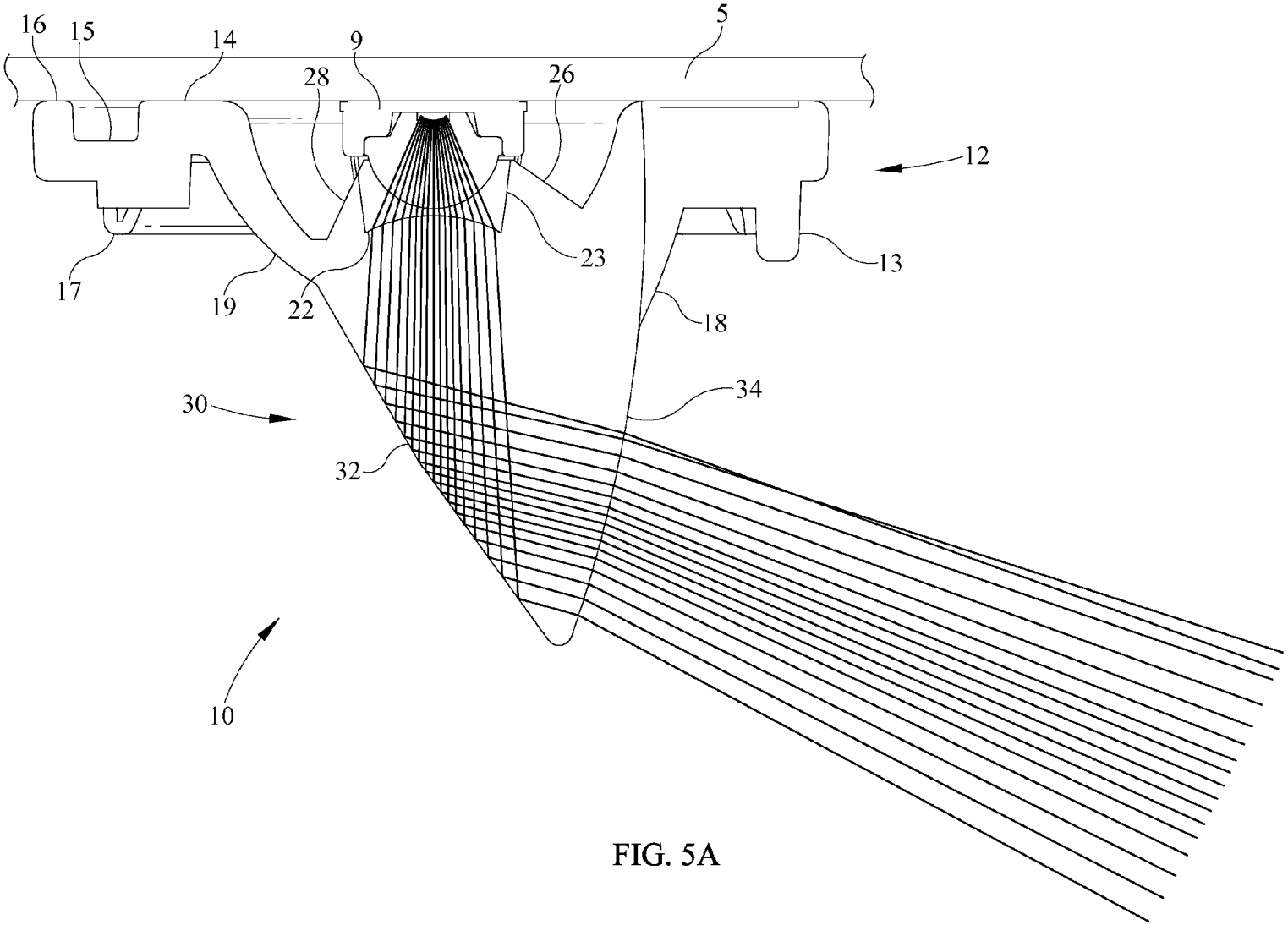
FIG. 5A is a sectional view of the orientable lens of FIG. 2 taken along the line 5-5 and shown about a LED with a ray trace of exemplary light rays that emanate from the LED and contact the refracting lens.
Figure 5B:
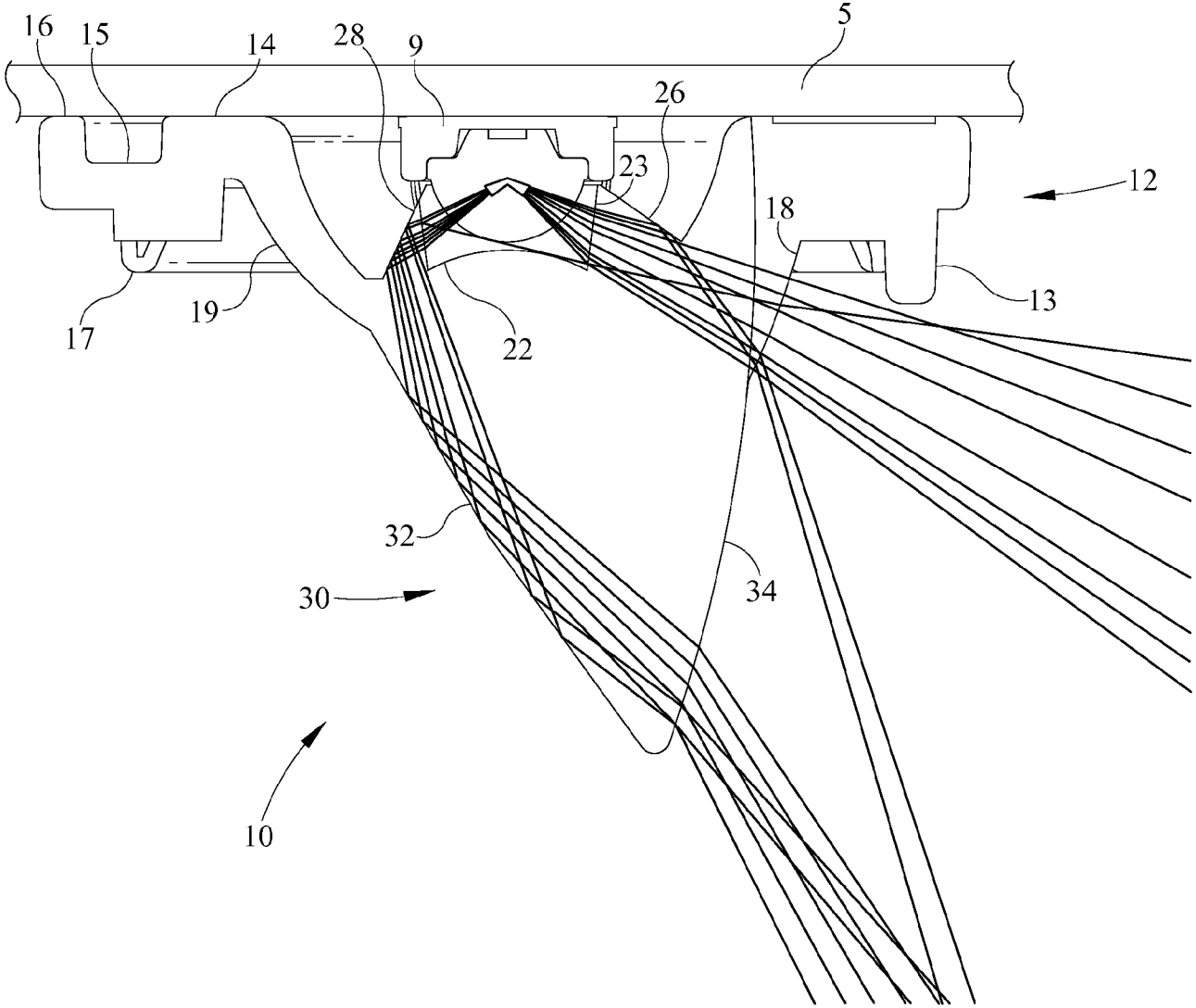
FIG. 5B is a sectional view of the orientable lens of FIG. 2 taken along the line 5-5 and shown about a LED with a ray trace of exemplary light rays that emanate from the LED and pass through a sidewall and either contact a reflecting portion or are directed towards an optical lens.

In some embodiments, other rays emanating from LED 9 will be incident upon sidewall 23 proximal surface 26, pass therethrough at an altered angle and will be directed towards an optical lens 34 of reflecting prism 30, such as the exemplary rays shown in FIG. 5B. A majority of these rays will pass through optical lens 34 and many of the rays will also pass through support 18 as shown in FIG. 5B. Also, as shown in FIG. 5B, some light rays may also be incident upon surface 26 and reflected and directed towards lens 34 and potentially support 18. In the depicted embodiments support 18 allows light rays to pass therethrough and may be configured to refract light rays passing therethrough in a desired direction. One skilled in the art will recognize that varying configurations of orientable lens 10 may call for varying configurations of any or all of refracting lens 22, sidewall 23, primary reflector 24, surface 26, and reflecting portion 28 in order to achieve desired light distribution characteristics.

In some embodiments, sidewall 23 is provided for provision of refracting lens 22 and many rays pass through sidewall 23 prior to being incident upon primary reflector 24 and potentially reflecting portion 28 and surface 26. In some embodiments sidewall 23 alters the travel path of rays passing therethrough. In some embodiments the height of sidewall 23 is shortened near its connection with reflecting portion 28. In other embodiments refracting lens 22 is positioned using thin supports attached to the inner surface of primary reflector 24 or otherwise and sidewall 23 is not provided. Also, in some embodiments, such as shown in the figures, sidewall 23 is provided and orientable lens 10 is formed from an integral molded solid unit of an appropriate medium. In these embodiments where orientable lens 10 forms an integral molded solid unit, once light rays emitted from LED enter orientable lens 10, they travel through the appropriate medium until they exit orientable lens 10. In some embodiments the medium is optical grade acrylic and all reflections occurring within orientable lens 10 are the result of internal reflection.

Reflective surface 32 of reflecting prism 30 may have a composition and orientation such that rays that have been collimated by refracting lens 22 or reflected by primary reflector 24 or reflecting portion 28 and directed towards reflective surface 32 are reflected off reflective surface 32 and directed towards optical lens 34, such as those rays shown in FIGS. 5A and 5B. Preferably the rays are internally reflected off reflective surface 32, although reflective surface 32 could also be formed of a reflective material. Most rays incident upon optical lens 34 pass through optical lens 34, potentially at an altered angle in some embodiments. Preferably, the direction of rays passing through optical lens 34 is only slightly altered. In embodiments where constituent parts of orientable lens 10 form an integral molded solid unit, reflective surface 32 internally reflects any rays incident upon it and rays that emanate from an LED and enter orientable lens 10 travel through the medium of orientable lens 10 until they exit orientable lens 10 through optical lens 34 or otherwise.

Reflective surface 32 of reflecting prism 30 need not be a flat surface. In some embodiments, such as those shown in the figures, reflective surface 32 actually comprises two faces at slightly different angles in order to allow more accurate control of light reflected from reflective surface 32 and to allow for a narrower range of light rays to be emitted by orientable lens 10. In other embodiments a reflective surface may be provided that is curved, concave, convex, or provided with more than two faces. Similarly, optical lens 34 may take on varying embodiments to allow more accurate control of light reflected from reflective surface 32 and/or to allow for a narrower range of light rays to be emitted by orientable lens 10.

Through use of orientable lens 10, the light emitted from a given LED is able to be redirected from the LED light output axis at angle from the LED light output axis. Since orientable lens 10 is installable at any orientation around an LED light output axis, this light can likewise be distributed at any orientation around an LED light output axis. Dependent on the configuration of a given orientable lens 10 and its constituent parts, the angle at which light emitted from an LED is redirected off its light output axis can vary. Moreover, the spread of the light beam that is redirected can likewise vary. When a plurality of orientable lenses 10 are used on a plurality of LEDS mounted on a surface, such as flat board 1 and plurality of LEDs 4, each orientable lens 10 can be installed at any given orientation around an LED axis without complicating the mounting surface. Moreover, complex photometric distribution patterns and a flexibility of light distributions can be achieved with a plurality of LEDs mounted on a surface, such as flat board 1 and plurality of LEDs 4.

Figure 7:
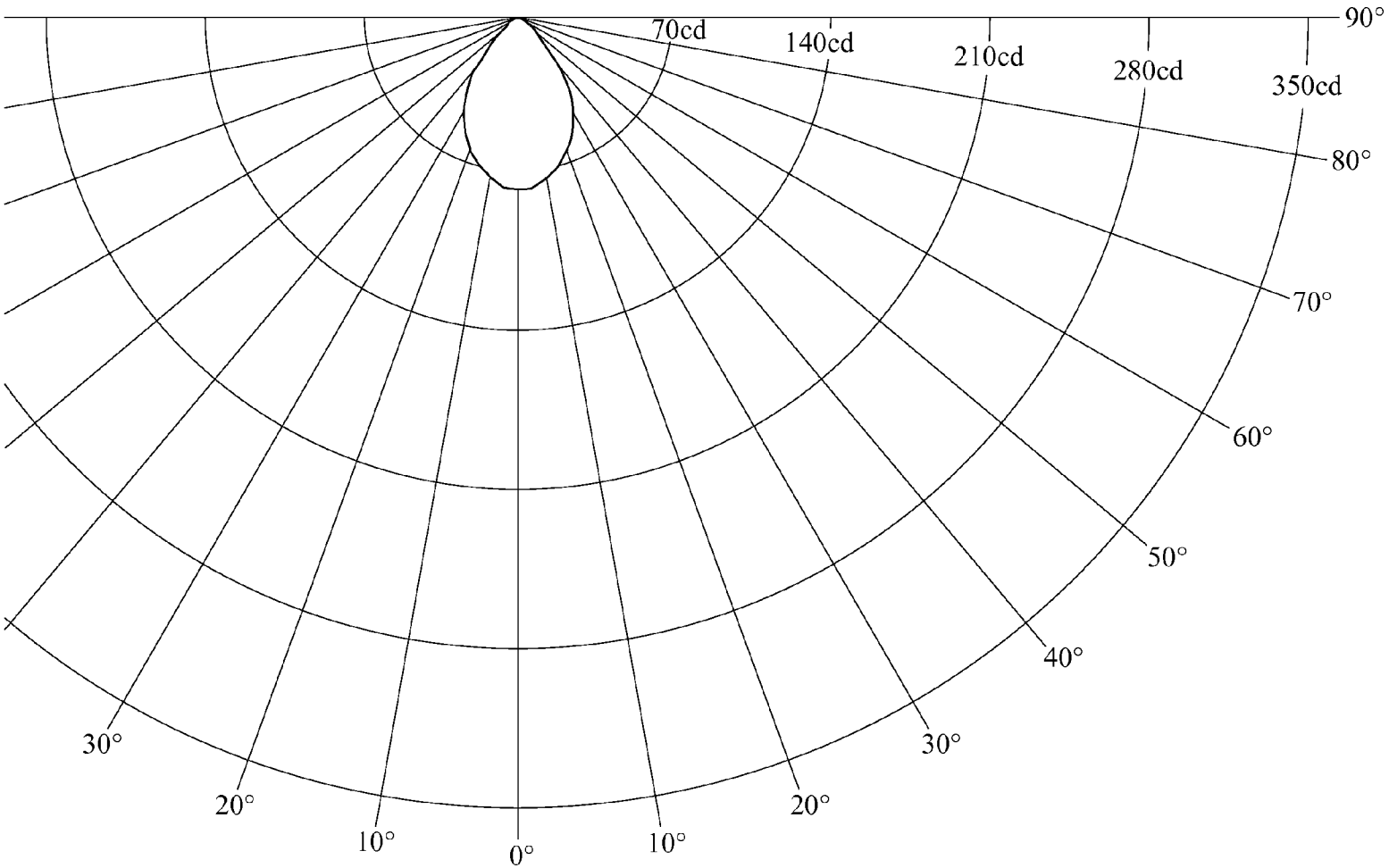
FIG. 7 shows a polar distribution in the vertical plane, scaled in candela, of a single LED with a Lambertian light distribution and without an orientable lens of the present invention in use.
Figure 8:
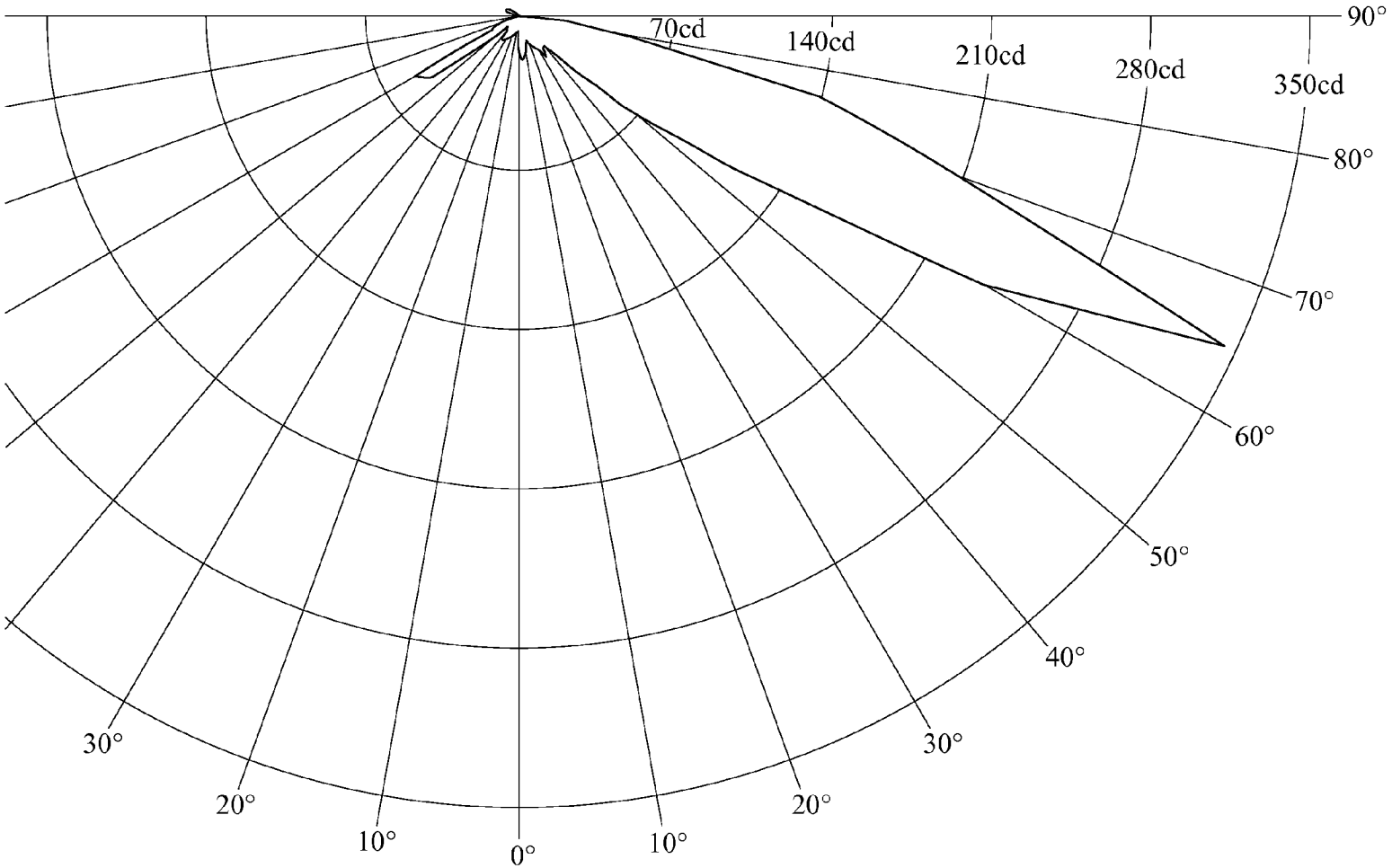
FIG. 8 shows a polar distribution in the vertical plane, scaled in candela, of the same LED of FIG. 7 with an embodiment of orientable lens of the present invention in use.
Figure 9:
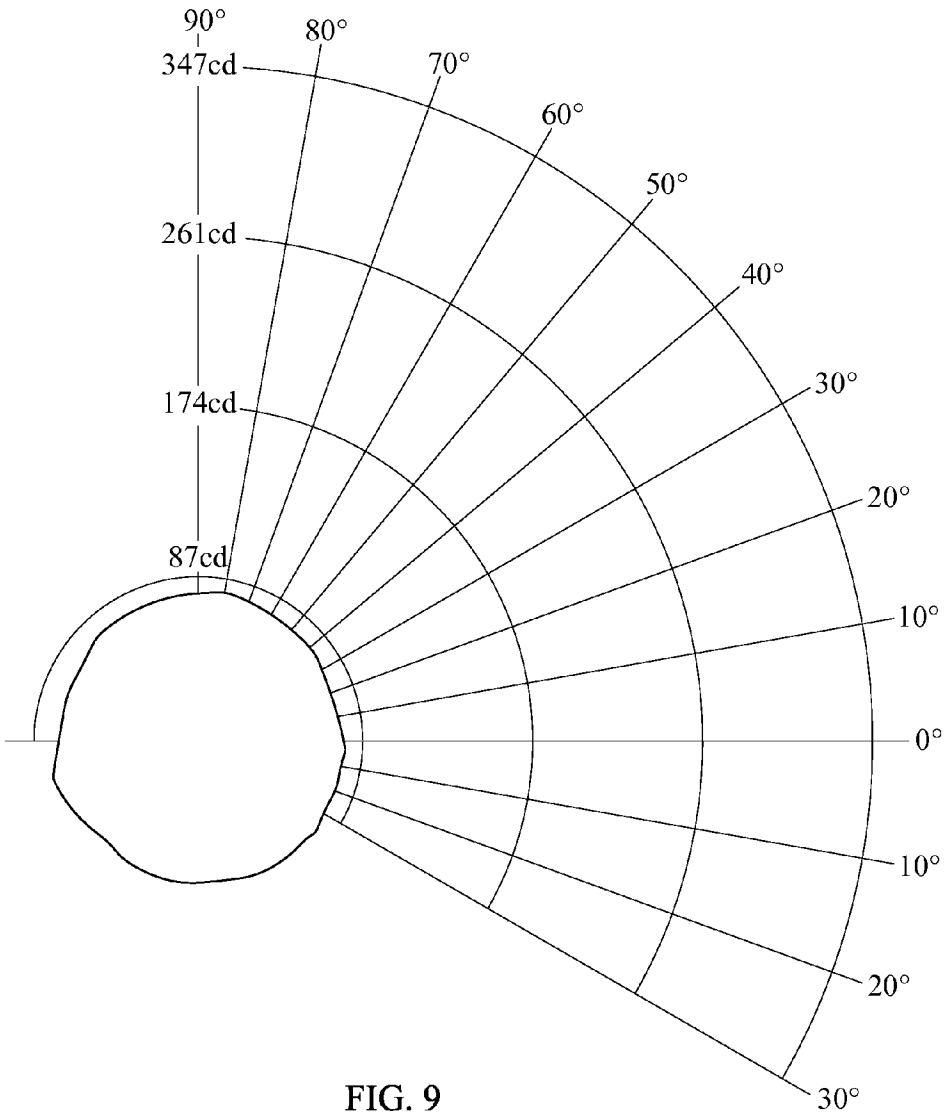
FIG. 9 shows a polar distribution in the horizontal plane, scaled in candela, of the same LED of FIG. 7 without an orientable lens of the present invention in use.
Figure 10:
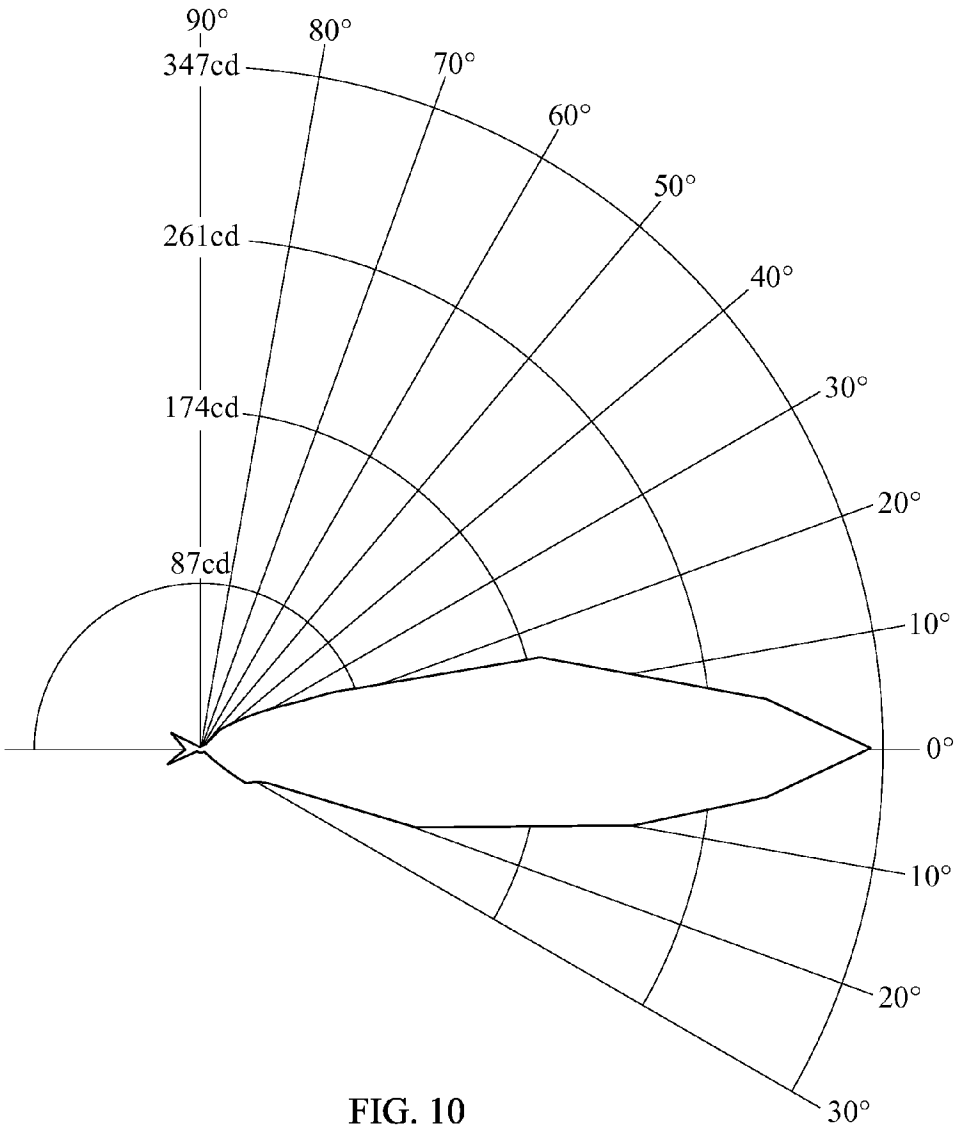
FIG. 10 shows a polar distribution in the horizontal plane, scaled in candela, of the same LED of FIG. 7 with the same orientable lens of FIG. 8 in use.

FIG. 7 shows a polar distribution in the vertical plane, scaled in candela, of a single LED with a Lambertian light distribution and without an orientable lens. FIG. 9 shows a polar distribution in the horizontal plane, scaled in candela, of the same led of FIG. 7. FIG. 8 shows a polar distribution in the vertical plane, scaled in candela, of the same LED of FIG. 7 with the embodiment of orientable lens showed in the figures in use. FIG. 10 shows a polar distribution in the horizontal plane, scaled in candela, of the same LED of FIG. 7 with the same orientable lens of FIG. 8 in use.

As can be seen from FIG. 8 and FIG. 10 orientable lens 10 directs a majority of light outputted by a LED with a Lambertian light distribution off a LED light output axis. In the vertical plane, shown in FIG. 8, a majority of the light is directed within a range from approximately 50° to 75° off the light output axis. In the horizontal plane, shown in FIG. 10, a majority of the light is directed within a 40° range away from the light output axis. Approximately 90% of light outputted by a LED with a Lambertian light distribution having the embodiment of orientable lens of FIG. 8 and FIG. 10 in use is distributed off the light output axis. FIG. 7-FIG. 10 are provided for purposes of illustration of an embodiment of orientable lens. Of course, other embodiments of orientable lens may be provided that produce differing polar distributions that direct light in a differing range off of and away from the light output axis. Thus, in the vertical plane of other embodiments light may be mainly directed in wider or narrower ranges and at a variety of angles away from the light output axis. In the horizontal plane of other embodiments light may likewise be directed in wider or narrower ranges.

Figure 11:
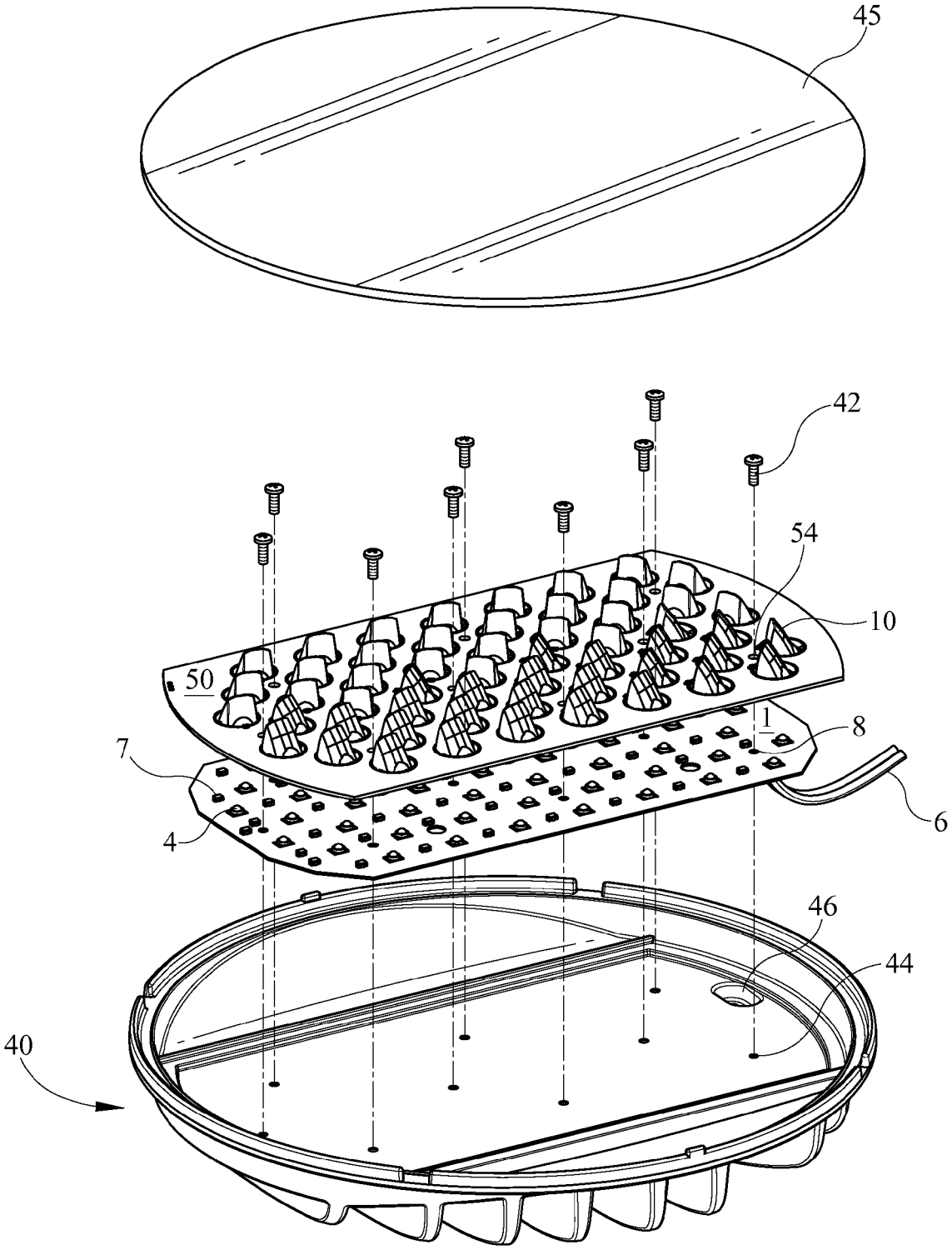
FIG. 11 is an exploded perspective view of an embodiment of a LED fixture with orientable lens shown with a flat board populated with a plurality of LEDs, a plurality of orientable lenses arranged in a positioning sheet, a heat sink, and a lens.

Referring to FIG. 11, an exploded perspective view of an embodiment of a LED fixture with a positioning sheet for orientable lenses is shown. Flat board 1 is populated with fifty-four LEDs 4 and has an electrical cable 6 for connecting flat board 1 to a power source. Flat board 1 is also populated with fifty-four Zener diodes 7 that are each electrically coupled with a LED 4 and allow current to bypass that LED 4 should it burn out. Fifty-four orientable lenses 10 are positioned along a positioning sheet 50 at various orientations. In some embodiments a portion of base 12 of each orientable lens 10 is affixed to an adhesive side of positioning sheet 50. In some embodiments of positioning sheet 50, positioning sheet 50 is a metallic board with advantageous heat distribution properties such as, but not limited to, aluminum. A lens 45 is also shown. In other embodiments of LED fixture with a positioning sheet for orientable lenses, differing amounts of LEDs 4, orientable lenses 10, and differing shapes and configurations of positioning sheet 50 and flat board 1 are provided.

When assembled, flat board 1 may be placed on heatsink 40 and alignment apertures 8 of flat board 1 aligned with threaded apertures 44 of heatsink 40. Positioning sheet 50 may then be placed adjacent flat board 1, causing base 12 of orientable lenses 10 to be sandwiched between positioning sheet 50 and flat board 1. Alignment apertures 54 of positioning sheet 50 may be aligned with alignment apertures 8 of flat board 1 and with threaded apertures 44 of heatsink 40. Nine threaded apertures 44 are placed in heatsink 40 and correspond in position to nine alignment apertures 54 of positioning sheet 50 and nine alignment apertures 8 of flat board 1. Electrical cable 6 may be placed through gasket 46 for attachment to a power source. Screws 42 may be inserted through alignment apertures 54 of positioning sheet 50 and apertures 8 of flat board 1 and received in threaded apertures 44 of heatsink 40. The head of screws 42 may contact positioning sheet 50 and screws 42 appropriately tightened to secure positioning sheet 50 and flat board 1 to heatsink 40 and to cause positioning sheet 50 to provide force against each base 12 of orientable lenses 10. This force causes each base 12 of orientable lenses 10 to be compressed between positioning sheet 50 and flat board 1 and causes each orientable lens 10 to be individually affixed about an LED 4 of flat board 1. Alignment apertures 54 and alignment apertures 8 are positioned so that when they are aligned each orientable lens 10 will be appropriately positioned about each LED 4. Lens 45 may then be coupled to heatsink 40.

Figure 12:
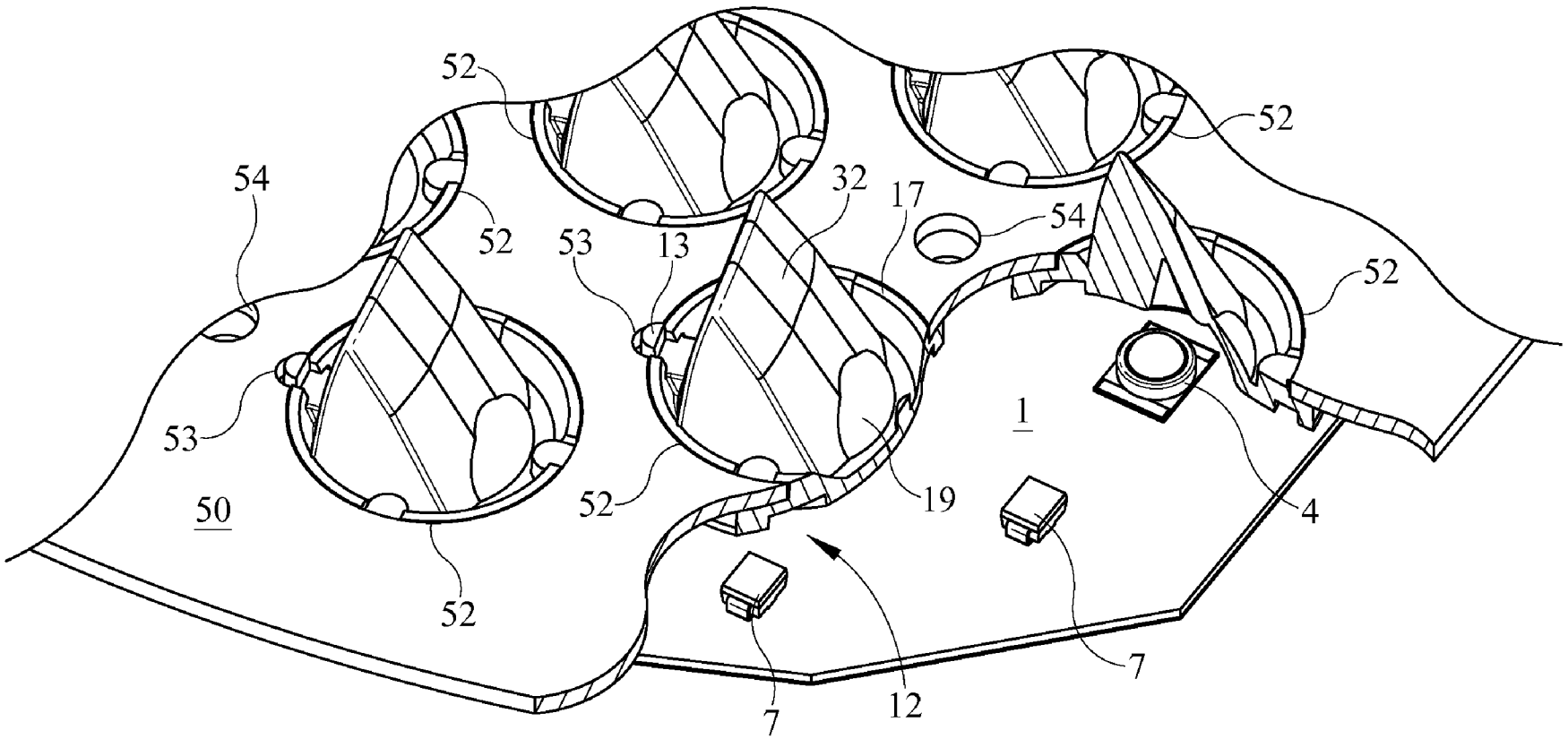
FIG. 12 is a perspective view of a portion of the flat board, positioning sheet, and orientable lenses of FIG. 11 with a portion of the positioning sheet and two orientable lenses cut away.
Figure 13:
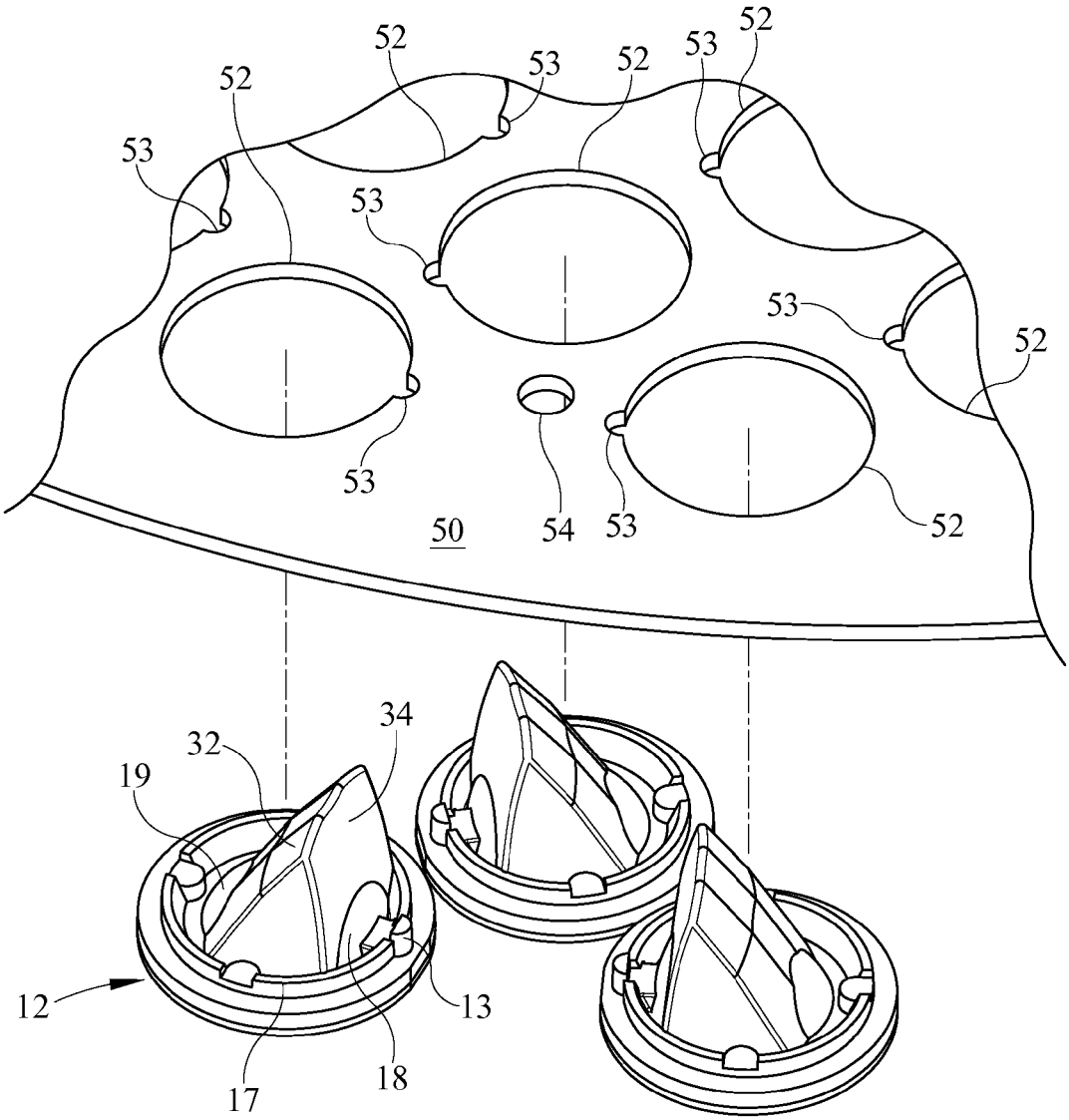
FIG. 13 is a perspective view of a portion of the positioning sheet and three orientable lenses of FIG. 11.

Referring to FIG. 12 and FIG. 13, the embodiment of positioning sheet 50 shown has a plurality of apertures 52 that each surrounds a portion one orientable lens 10. Only one orientable lens 10 is shown with reference numbers in each of FIG. 12 and FIG. 13 to simplify the Figures. In the depicted embodiments each aperture 52 has an alignment notch 53 that corresponds to an alignment structure having an alignment protrusion 13 that extends from base 12 of each orientable lens 10. Alignment notch 53 receives alignment protrusion 13 to ensure each orientable lens 10 is appropriately oriented about a corresponding LED to achieve a particular light distribution for the LED fixture. In the depicted embodiments, rim portion 17 of base 12 abuts the inner periphery of aperture 52 and also helps position each orientable lens 10 in aperture 52. In some embodiments the side of positioning sheet 50 that contacts the flange portion around rim portion 17 is adhesive and adheres to flange portion of base 12 surrounding rim portion 17. This may help maintain orientable lenses 10 in position while placing positioning sheet 50 adjacent flat board 1 so that a portion of each orientable lens 10 is compressed between positioning sheet 50 and flat board 1. Through use of positioning sheet 50, orientable lenses 10 may be individually oriented and accurately positioned with respect to a plurality of LEDs on a mounting surface.

Although positioning sheet 50 and its interaction with orientable lenses 10 is shown in detail in FIG. 11-13, it is merely exemplary of one embodiment of positioning sheet 50 and orientable lenses 10. There are a variety of different shapes, constructions, orientations, and dimensions of positioning sheet 50, flat board 1, and orientable lenses 10 that may be used as understood by those skilled in the art. For example, in some embodiments, some or all of apertures 52 of positioning sheet 50 may be provided with a plurality of alignment notches 53 that correspond with one or more alignment protrusions 13. This alignment structure would enable an orientable lens 10 to be placed in aperture 52 at any one of a plurality of orientations and enable a single positioning sheet 50 to be used to achieve various light distribution patterns. Also, for example, in some embodiments apertures 54 and orientable lenses 10 may be provided without alignment apertures and notches and each orientable lens 10 may be individually oriented within apertures 54 at a given orientation by a robotic type assembly. Also, for example, in some embodiments, apertures 52 may be provided with alignment protrusions that are received in corresponding alignment notches of orientable lenses 10. Also, for example, in some embodiments apertures 52 may be square, rectangular, or otherwise shaped and orientable lenses 10 could be configured to interact with such shapes. Also, for example, in some embodiments a single aperture 52 may be configured to surround and secure more than one orientable lens 10. Also, for example, in some embodiments rim portion 17 may not be present or may be square, rectangular, or otherwise shaped.

Moreover, there are a variety of ways positioning sheet 50 may be positioned and secured to provide force on orientable lenses 10 and cause each orientable lens 10 to be positioned about an LED and compressed between positioning sheet 50 and a mounting surface as understood by those skilled in the art. For example, flat board 1 may be provided with one or more protrusions extending perpendicularly from the LED mounting surface of flat board 1. The one or more protrusions could be received in one or more alignment apertures 54 of positioning sheet 50 to appropriately align each orientable lens 10 about an LED 4. Positioning sheet 50 could then be secured to heatsink 40 using screws or other securing device. Also, for example, positioning sheet 50 and flat board 1 may be secured adjacent one another and secured to heatsink 40 in a variety of ways. For example, positioning sheet 50 and flat board 1 may be secured adjacent one another using a plurality of securing clips and secured to heatsink 40 using screws that extend through heatsink 40 and are received in threaded apertures provided in flat board 1. Also, for example, adhesives may be used to secure positioning sheet 50, flat board 1, and/or heatsink 40 to one another. Moreover, positioning sheet 50 may be aligned with respect to flat board 1 in other ways than with alignment apertures 54 and alignment apertures 8 as understood by those skilled in the art. For example, they may be robotically aligned or may be aligned by lining up their peripheries with one another.

The foregoing description has been presented for purposes of illustration. It is not intended to be exhaustive or to limit the invention to the precise forms disclosed, and obviously many modifications and variations are possible in light of the above teaching. It is understood that while certain forms of the orientable lens for a led fixture have been illustrated and described, it is not limited thereto except insofar as such limitations are included in the following claims and allowable functional equivalents thereof.

I claim:

1. An optical system for a LED fixture, comprising:

a mounting surface;

a plurality of individual LEDs attached to said mounting surface;

a plurality of orientable lenses each having a base;

a positioning sheet in contact with said base of each of said orientable lenses that provides force on said base of each of said orientable lenses in a direction towards said mounting surface, thereby compressing a portion of each of said orientable lenses between said mounting surface and said positioning sheet;

wherein said base of each of said orientable lenses is adjacent to said mounting surface about a single LED of said plurality of LEDs;

wherein said positioning sheet has a plurality of lens apertures, each of said lens apertures having at least one of an alignment protrusion and an alignment notch, each of said lens apertures surrounding one of said orientable lenses having a corresponding other of said alignment protrusion and said alignment notch, wherein said alignment protrusion and said alignment notch interface to position each of said orientable lenses at a predefined rotational angle;

wherein each of said orientable lenses has a primary reflector at least partially surrounding a refracting lens; and wherein said refracting lens and said primary reflector of each of said orientable lenses collimate light emitted from said single LED to a reflective surface supported by said base of each of said orientable lenses and angled to reflect a majority of said light off a LED light output axis of said single LED.

2. The optical system for a LED fixture of claim 1, further comprising a heatsink thermally coupled to said mounting surface.

3. The optical system for a LED fixture of claim 1, wherein each of said orientable lenses has said alignment protrusion and each of said lens apertures has said alignment notch.

4. The optical system for a LED fixture of claim 1, wherein each of said orientable lenses has a first portion most proximal said mounting surface and a second portion most distal said mounting surface, and wherein a majority of said positioning sheet is more proximal said first portion than said second portion.

5. The optical system for a LED fixture of claim 1, wherein each of said orientable lenses has a first portion most proximal said mounting surface and a second portion most distal said mounting surface, and wherein said base is more proximal said first portion than said second portion.

6. An optical system for a LED luminaire, comprising:

a mounting surface;

a plurality of individual LEDs attached to said mounting surface;

a plurality of orientable lenses each having a base;

wherein said base of each of said orientable lenses is adjacent to said mounting surface about a single LED of said plurality of LEDs;

a positioning sheet in contact with said base of each of said orientable lenses, said positioning sheet having a plurality of lens apertures, each of said lens apertures surrounding a portion of one of said orientable lenses;

wherein at least a portion of said orientable lenses extends past said positioning sheet;

whereby said positioning sheet provides force on said base of each of said orientable lenses in a direction towards said mounting surface, thereby compressing each of said orientable lenses against said mounting surface;

wherein at least some of said orientable lenses have a primary reflector at least partially surrounding a refracting lens; and wherein said refracting lens and said primary reflector collimate light emitted from said single LED to a reflective surface supported by said base and angled to reflect a majority of said light off a LED light output axis of said single LED.

7. The optical system for a LED luminaire of claim 6, further comprising a heatsink thermally coupled to said mounting surface.

8. The optical system for a LED luminaire of claim 6, wherein each of said lens apertures has an alignment notch and each of said orientable lenses has an alignment protrusion extending from said base and received in said alignment notch.

9. The optical system for a LED luminaire of claim 8, wherein each of said orientable lenses has said primary reflector at least partially surrounding said refracting lens.

10. An optical system for a LED luminaire, comprising:

a mounting surface supporting a plurality of LEDs, said mounting surface also supporting electrical connections from said plurality of LEDs to a power supply;

a positioning sheet mountable adjacent to said mounting surface and having a plurality of apertures such that when said positioning sheet is mounted adjacent said mounting surface, said plurality of apertures are aligned with said plurality of LEDs of said mounting surface;

a plurality of lenses having a base positioned between said positioning sheet and said mounting surface, at least a portion of each of said lenses extending past said positioning sheet;

wherein said lenses are individually rotatable within each of said apertures to redirect light emitted from at least a single LED of said LEDs positioned directly below each of said lenses to a predefined location, each of said lenses having an alignment structure allowing each of said lenses to be locked into at least one predefined rotational angular position about said LED positioned directly below said lens;

wherein each of said lenses have a primary reflector at least partially surrounding a refracting lens; and wherein said refracting lens and said primary reflector collimate light emitted from said single LED to a reflective surface supported by said base and angled to reflect a majority of said light off a LED light output axis of said single LED.

11. The optical system for a LED luminaire of claim 10, wherein said alignment structure includes at least one alignment protrusion.

12. The optical system for a LED luminaire of claim 11, wherein said alignment protrusion extends from said base of each of said lenses.

13. The optical system for a LED luminaire of claim 11, wherein said positioning sheet has a plurality of alignment receptacles each configured to receive a single said alignment protrusion.

14. The optical system for a LED luminaire of claim 13, wherein at least some of said alignment receptacles are each provided in a single of said apertures.

15. The optical system for a LED luminaire of claim 10, wherein a rim portion extends from said base of each of said lenses, each said rim portion abutting a corresponding said aperture of said positioning sheet.

* * * * *